US006659743B2

(12) United States Patent
Kimura et al.

(10) Patent No.: US 6,659,743 B2
(45) Date of Patent: Dec. 9, 2003

(54) SCROLL FLUID MACHINE HAVING MULTISTAGE COMPRESSING PART

(75) Inventors: Hideyuki Kimura, Kanagawa-ken (JP); Atsushi Unami, Kanagawa-ken (JP)

(73) Assignee: Anest Iwata Corporation, Tokyo (JP)

( * ) Notice: Subject to any disclaimer, the term of this patent is extended or adjusted under 35 U.S.C. 154(b) by 0 days.

(21) Appl. No.: 10/091,599

(22) Filed: Mar. 7, 2002

(65) Prior Publication Data

US 2002/0131882 A1 Sep. 19, 2002

(30) Foreign Application Priority Data

Mar. 7, 2001 (JP) ..... 2001-063515

(51) Int. Cl.[7] ..... F04C 18/04; F04C 23/00
(52) U.S. Cl. ..... 418/6; 418/55.2
(58) Field of Search ..... 418/5, 6, 55.2

(56) References Cited

U.S. PATENT DOCUMENTS 4,141,677 A * 2/1979 Weaver et al. ..... 418/6
4,477,238 A * 10/1984 Terauchi ..... 418/5
6,050,792 A * 4/2000 Shaffer ..... 418/6

* cited by examiner

*Primary Examiner*—John J. Vrablik
(74) *Attorney, Agent, or Firm*—Crowell & Moring LLP

(57) ABSTRACT

The present invention has an object of offering a scroll fluid machine having a multi-stage compressing part which is characterized in that volumes of a sealed spaces is less scattering thereof corresponding to the given angle rotational amount of the revolving scroll driving shaft. In a scroll fluid machine having a multi-stage compressing part which further compresses fluid, which have been compressed by a front stage compressing part and cooled, with a back-stage compressing part, a scroll fluid machine having a multi-stage compressing part which is characterized in that a reduction ratio $\Delta Y$ of a volume of a compression chamber is smaller in a back compressing part than in a front compressing part, $\Delta Y$ being expressed by $\Delta Y=\{A(n-1)-An\}/A(n-1)$, where A is the volume of a compression chamber defined by a scroll wrap and a scroll mirror plane, $A(n-1)$ is the volume of a compression chamber at the rotational angle $\Delta\omega(n-1)$, An is the volume of a compression chamber at the rotational angle $\Delta\omega n$ and $\Delta\omega$ is the rotational angle of the driving shaft 16 of a revolving scroll.

4 Claims, 6 Drawing Sheets

SCROLL FLUID MACHINE HAVING MULTISTAGE COMPRESSING PART

BACKGROUND TO THE INVENTION

1. Field of the Invention

The present invention relates to a scroll fluid machine which compresses fluid, expands fluid and delivers fluid under pressure and more particularly to a scroll fluid machine having a multi-stage compressing part which compresses fluid having been compressed by a front-stage compressing part and cooled, and further compresses the fluid with a back-stage compressing part.

2. Description of the Related Art

Heretofore, it was possible to increase the compression ratio by increasing the number of wrap turns. However, increasing the compression ratio results in problems such as having an unnecessarily large structure and also incurring a decline in the life of the bearings and sealing parts owing to the high temperatures generated by the compression of the fluid.

Hence, the structure of the cooler needs to be enlarged in order to cool the revolving scroll and the stationary scroll using greater amount of cooling energy of the cooler than usual. In a scroll fluid mechanism, fluid is obtained from the outer circumference of the revolving scroll base and the fluid is compressed by reducing the fluid-compressing pocket, in which the fluid is obtained, toward the center and the compressed fluid is discharged from the discharge port disposed at the center region. Therefore, a highly developed technique is required in order to cool the center region effectively.

By the aforementioned reason, a multi-stage compression scroll fluid machine is required wherein a cooler is disposed adjacent to the scroll fluid mechanism and a compressing part of the scroll fluid machine is separated into two stages so that a compressed fluid from a front compressing stage is led to and cooled in said cooler and the cooled fluid is introduced to a back compressing stage to compress again. Said multi-stage compression scroll fluid machine is able to obtain a desired compression ratio without reaching a higher temperature than usual, by compressing at a front stage to a pressure such that the temperature is limited to what the scroll fluid machine is designed to withstand, and then passing the compressed fluid through an intermediate cooler, and then further compressing at a back-stage until reaching the same limited temperature as at the front-stage compression.

The aforementioned multi-stage compression scroll fluid machine wherein a compressing part of the scroll fluid machine is separated into two stages so that a compressed fluid from a front compressing stage is led to and cooled in a cooler and the cooled fluid is introduced to a back compressing stage to compress again has been publicly known by the publication of unexamined application Shou54-59608.

An obtained fluid compressing characteristic curve $L_1$, $L_2$ of a prior art is shown in FIG. 6, where the vertical axis denotes a fluid pocket pressure $P_3$ and the horizontal axis denotes a rotational angle $\omega$ of a revolving scroll driving shaft (a crank shaft). Compressing behavior along the characteristic curve is as follows. The obtained fluid in the fluid pocket of a pressure $P_0$ indicated by "a" is compressed to a pressure $P_1$ indicated by "b" where the compressed fluid is cooled. The cooled fluid is further compressed along the curve $L_2$ to the point "d" of the fluid pressure $P_3$ (the discharge pressure).

Meanwhile, the fluid pressure pocket volume corresponding to a given rotational angle of the rotational driving shaft varies with production errors which are brought about in the production of such as a stationary scroll wrap, a revolving scroll wrap, a revolving scroll driving shaft or a crankshaft for preventing the rotation of the revolving scroll. Directing our attention to the characteristic curve $L_2$ of the back compressing stage, a variation in inner pressure by an amount $\Delta P$ of the fluid pocket containing compressed fluid of the sealed space corresponding to a given angle rotational amount $\Delta\omega$ of the revolving scroll driving shaft is generated with each compressor.

As shown in FIGS. 4 and 5, fluid pressure pockets are formed as depicted as sealed spaces S inside and T outside of a revolving scroll wrap. These sealed spaces communicate with a discharge port after forming last compression chambers so that compressed fluids in the last compression chambers are mixed together in the discharge port to discharge to the outside of the compressor. Therefore, the discharge pressure at the discharge port varies so as to result in over-compression or insufficient compression owing to the variation in inner pressure by an amount $\Delta P$ of the fluid pocket containing the compressed fluid of each sealed space such as the sealed space S and T corresponding to the given angle of rotation $\Delta\omega$ of the revolving scroll driving shaft.

SUMMARY OF THE INVENTION

The present invention has done in the light of the aforementioned problem and has an object of offering a scroll fluid machine having a multi-stage compressing part which is characterized in that the volumes of sealed spaces corresponding to the given angle of rotation of the revolving scroll driving shaft show less variation.

The first part of the present invention is characterized in that in a scroll fluid machine having a multi-stage compressing part which compresses fluid with a back-stage compressing part, the fluid having been compressed by a front stage compressing part and cooled, a reduction ratio $\Delta Y$ of a volume of a compression chamber is smaller in a back compressing part than in a front compressing part, $\Delta Y$ being expressed by $\Delta Y=\{A(n-1)-An\}/A(n-1)\}$, where A is the volume of a compression chamber defined by a scroll wrap and a scroll mirror plane, $A(n-1)$ is the volume of a compression chamber at the rotational angle $\Delta\ \omega(n-1)$, An is the volume of a compression chamber at the rotational angle $\Delta\ \omega n$ and $\Delta\omega$ is the rotational angle of a driving shaft of a revolving scroll.

According to the first part of the present invention, as the reduction ratio $\Delta Y$ of the volume of the compression chamber is smaller in the back compressing part than in the front compressing part, the reduction ratio $\Delta Y$ of the volume of the compression chamber defined by the scroll wrap and the scroll mirror plane corresponding to the rotational angle of the scroll driving shaft is small so that a varying extent of a pressure P in the sealed space which forms the volume of the compression chamber is small. Thus, a characteristic curve of said pressure P in the sealed space inclines gently. Consequently, a multi-stage compression scroll fluid machine having less variation in inner pressure of the fluid pocket containing the compressed fluid of each sealed space by an amount $\Delta P$ and a stable discharge pressure can be offered.

The second part of the present invention is characterized in that in a scroll fluid machine having a multi-stage compressing part which compresses fluid with a back stage compressing part, the fluid having been compressed by a front stage compressing part and cooled, a distance between the mirror planes of the wraps in the back-stage compressing part is larger than a distance between the mirror planes of the wraps in the front-stage compressing part.

According to the second part of the present invention, in the back-stage compressing part where the pressure of the sealed space is larger than the front-stage compressing part corresponding to the given rotational angle of the scroll driving shaft, a volume reduction ratio by compression is smaller in a degree proportioned to a longer distance between the mirror planes of the wraps so that a varying extent of a pressure P in the sealed space which forms the volume of the compression chamber is small. Thus, a characteristic curve of said pressure P in the sealed space inclines gently. Consequently, a multi-stage compression scroll fluid machine having only a small variation in inner pressure of the fluid pocket containing the compressed fluid of each sealed space by an amount $\Delta P$ and a stable discharge pressure can be offered.

As an alternative effective means of the first or second part of the present invention, the scroll fluid machine is constructed so that a distance between the mirror planes of the wraps in the front-stage compressing part and in the back-stage compressing part turns longer along the direction from the suction port to the discharge port of the fluid.

According to said technical means, the scroll fluid machine can be constructed so that a distance between the mirror planes of the wraps in the front-stage compressing part together with the back-stage compressing part turns stepwise or gradually longer along the direction from the suction port to the discharge port of the fluid. That is to say, the ratio of the decreasing volume by compression corresponding to the given rotational angle of the scroll driving shaft gets smaller as the fluid pocket draws near to the discharge port in the front-stage compressing part together with the back-stage compressing part so that a varying extent of a pressure P in said sealed space which forms the volume of the compression chamber is small. Thus, a characteristic curve of said pressure P in the sealed space inclines gently. Consequently, a multi-stage compression scroll fluid machine having less variation in inner pressure of the fluid pocket containing the compressed fluid of each sealed space by an amount $\Delta P$ and a stable discharge pressure can be offered.

THE BEST MODE FOR CARRYING OUT THE INVENTION

The invention will now be described in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

Figure 1:
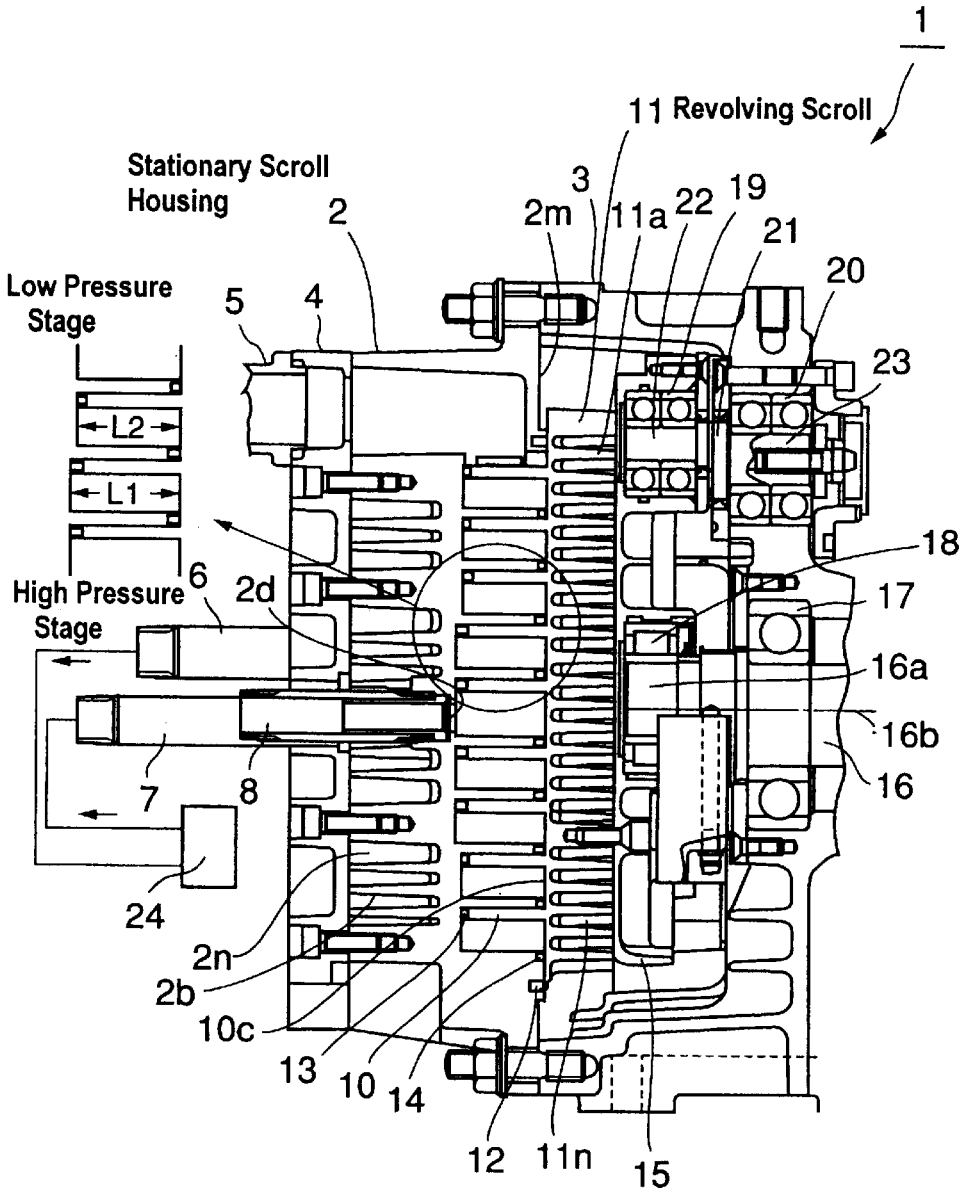
FIG. 1 is a sectional view of one embodiment of a scroll fluid machine according to the present invention.
Figure 2:
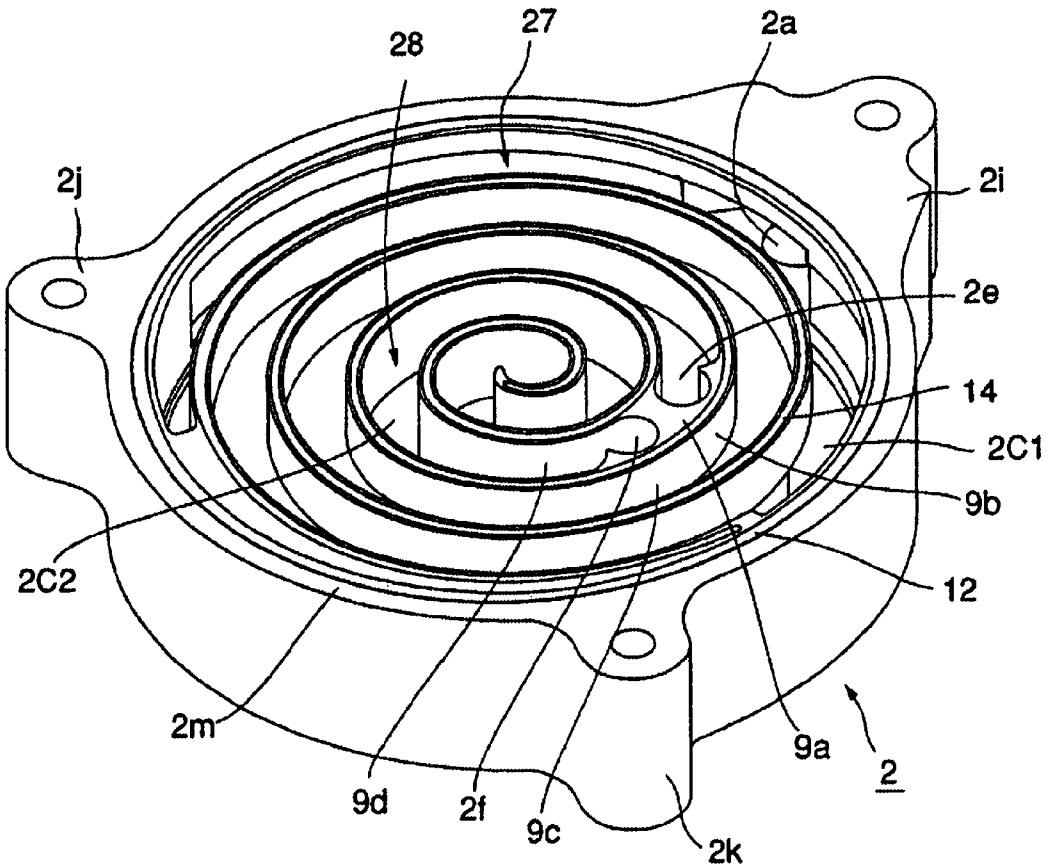
FIG. 2 is a perspective view of a stationary scroll housing.
Figure 3:
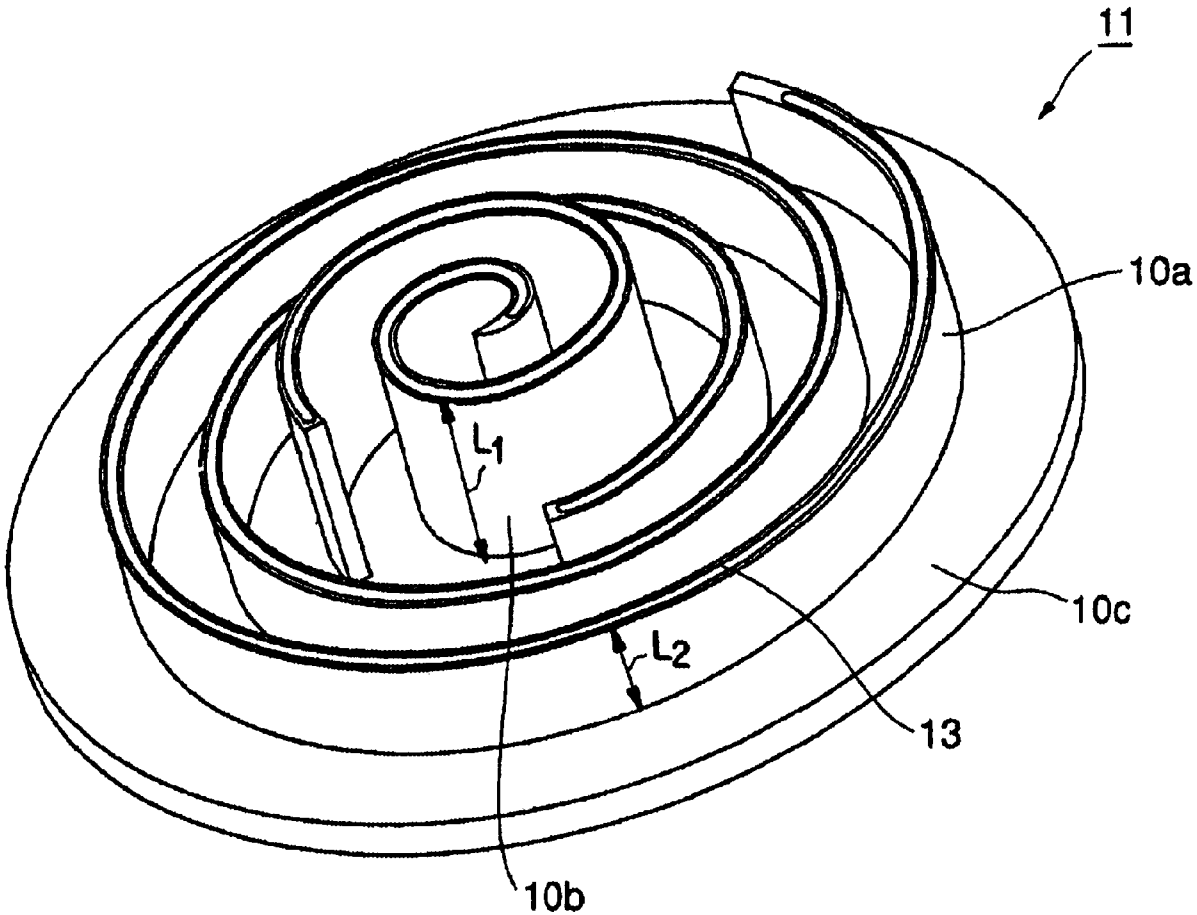
FIG. 3 is a perspective view of a revolving scroll.
Figure 4:
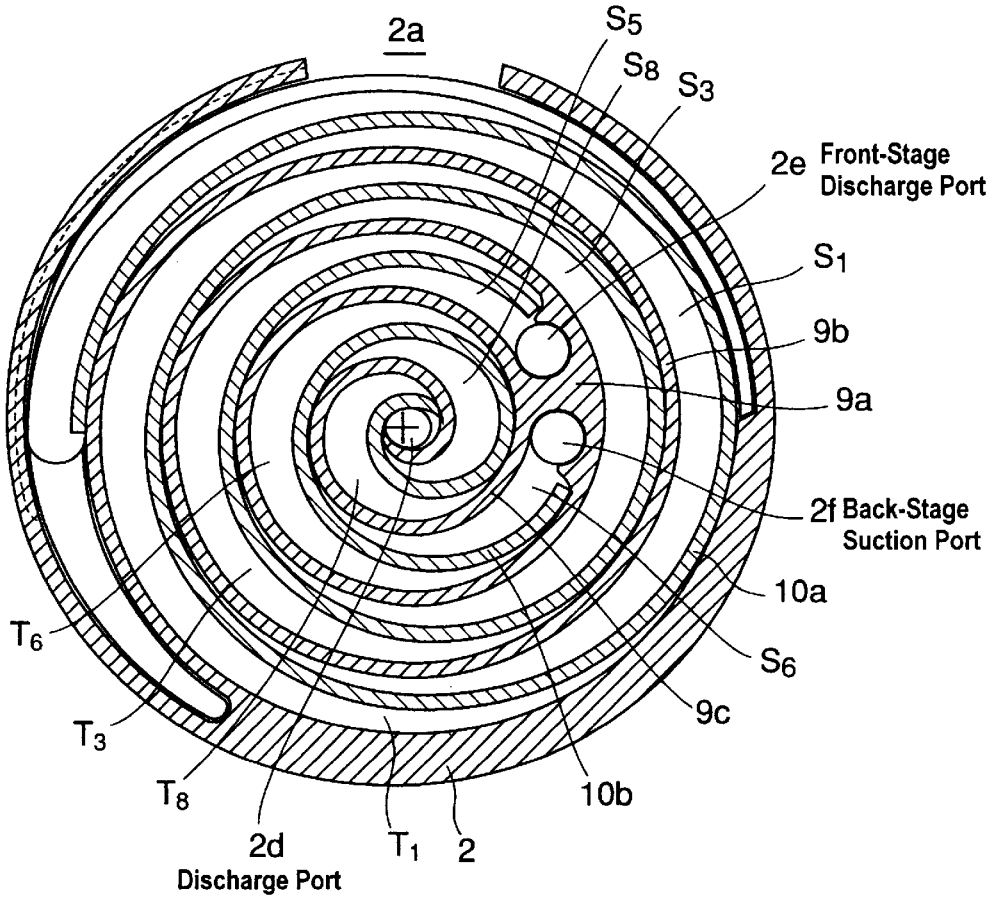
FIG. 4 is a schematic drawing illustrating a state of compressing fluid in case of entrapping fluid from one side of wall faces of a revolving scroll wrap.
Figure 5:
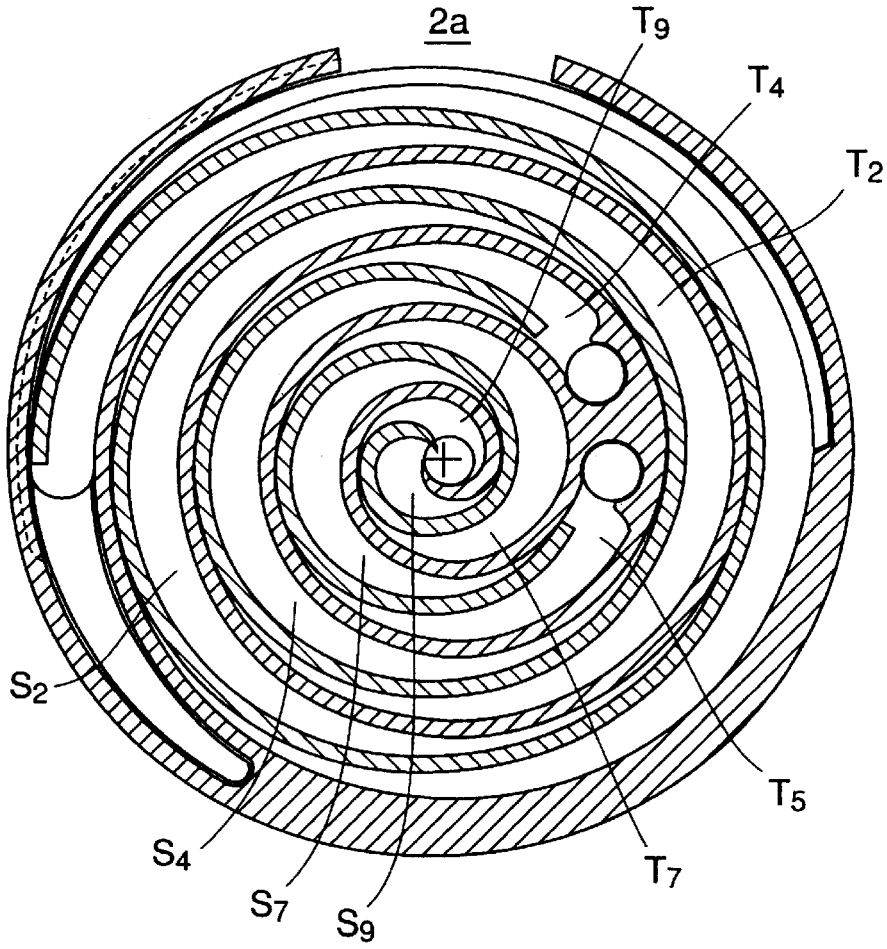
FIG. 5 is a schematic drawing illustrating a state of compressing fluid in case of entrapping fluid from the other side of wall faces of a revolving scroll wrap.
Figure 6:
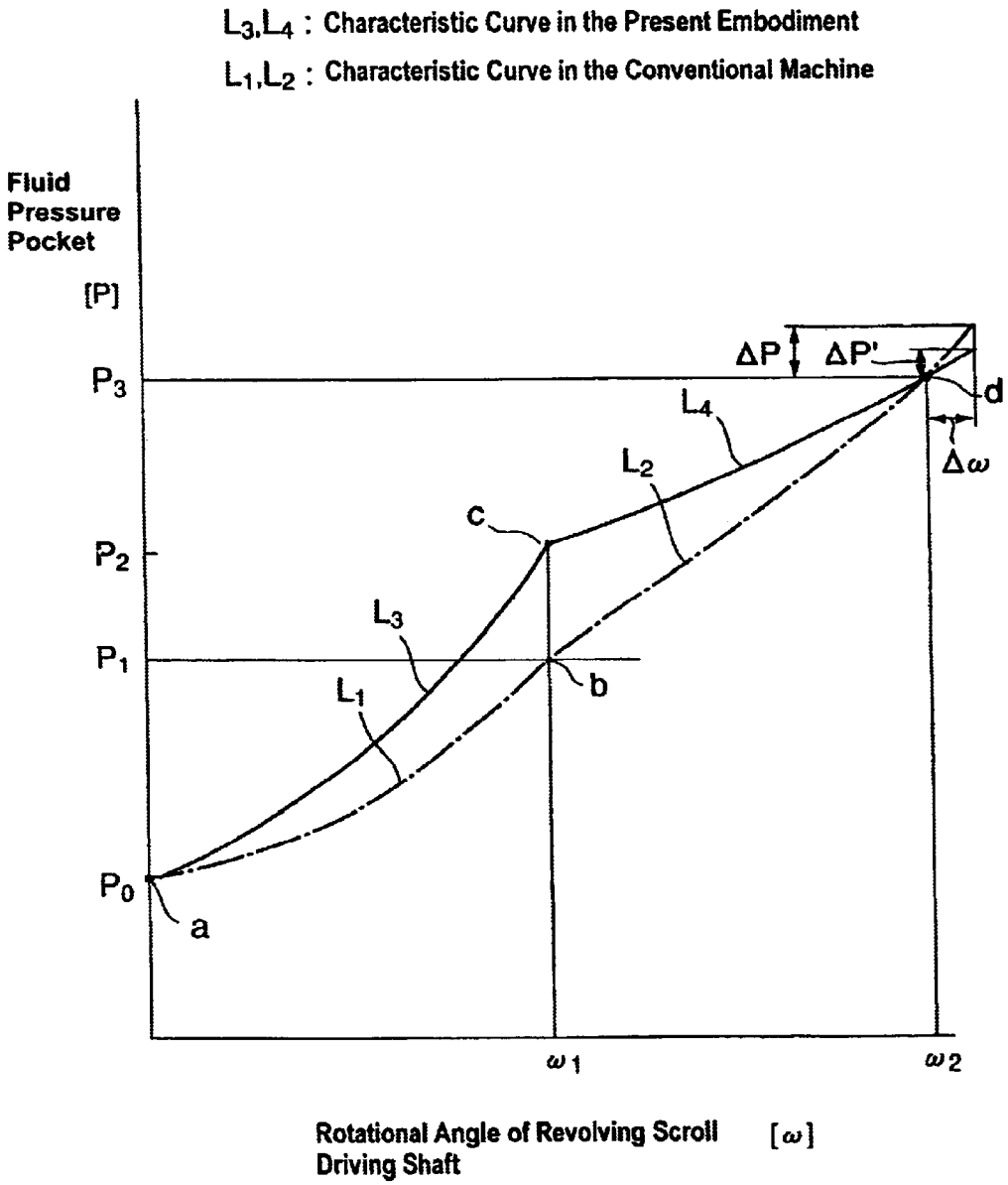
FIG. 6 is a schematic drawing illustrating a behavior of compressing fluid in a scroll fluid machine.

FIG. 1 is a sectional view of one embodiment of a scroll fluid machine according to the present invention. FIG. 2 is a perspective view of a stationary scroll housing. FIG. 3 is a perspective view of a revolving scroll. FIG. 4 is a schematic drawing illustrating a state of compressing fluid in case of entrapping fluid from one side of wall faces of a revolving scroll wrap. FIG. 5 is a schematic drawing illustrating a state of compressing fluid in case of entrapping fluid from the other side of wall faces of a revolving scroll wrap. FIG. 6 is a schematic drawing illustrating a behavior of compressing fluid in a scroll fluid machine.

As shown in FIG. 1, the body of a multi-stage scroll fluid mechanism (the body of a scroll) 1 comprises a stationary scroll housing 2 fixed with a housing cover 4 and a driving shaft housing 3 fixed with said stationary scroll housing 2. A cooler 24 is disposed between a discharge pipe 6 fixed to a discharge port of a front-stage compressing part of the stationary scroll housing 2, which is mentioned later and a suction pipe 7 fixed to a suction port of a back-stage compressing part. An intermediate route is constructed by connecting said cooler 24 with the discharge pipe 6 and the suction pipe 7 by means of piping work.

As indicated in FIG. 2, the intermediate route has a total volume of piping through a front stage discharge port 2*e*, a back-stage suction port 2*f*, and the inner of the cooler which exists between said ports. The total volume is set to the N (integer) times of the volume of a last compression chamber in the front-stage compressing part. After N times' discharges from the last compression chamber in the front-stage compressing part, the back-stage compressing part entraps, as a first stage suction of the back-stage compressing part, a volume of fluid equal to the volume of the last compression chamber in the front-stage compressing part.

At the start of running, however, as the scroll fluid machine is at a standstill, the last compression chamber in the back-stage compressing part of the fluid compressing space defined by the stationary scroll wrap and the revolving scroll wrap contains the fluid having the same pressure as or higher pressure than the outer pressure of the discharge port 2*d* (FIG. 1) in the back-stage compressing part and the fluid having existed in the initial obtained space and communicating with said intermediate route is reduced in pressure some times.

When initial running is started in this state, the residual fluid in the back-stage compressing part is compressed to a pressure higher than the outside pressure. That is, when the compressed fluid of the last compression chamber in the back stage is combined with the compressed fluid of the compression chamber ahead of the last one to be compressed higher than the outside pressure, the compressed fluid is discharged to the outside. If the pressure is still lower than the outside pressure, then the fluid of said intermediate route is obtained and combined with the fluid of the discharge port side to be compressed.

At about the end of the initial running, after N-times' discharges from the last compression chamber in the front-stage compressing part, the running state becomes such that the back-stage compressing part contains, as a first stage suction of the back-stage compressing part, a volume of fluid equal to the volume of the last compression chamber in the front-stage compressing part.

The stationary scroll housing is formed as a circular tray, as shown in FIG. 2, having fixing parts 2*i*, 2*j* and 2*k* at three places of the peripheral direction on its peripheral face, the fixing parts being joined with the driving shaft housing 3, which is stated later, by a joining face 2*m*. A mirror plane $2c_1$ is provided on a recessing part formed by a wrap groove 27 of the front-stage compressing part. Said mirror plane $2c_1$ communicates with a passage 2*a*, which is provided at the inner part of the fixing part 2*i*. A mirror plane $2c_2$ is provided on a recessing part formed by a wrap groove 28 of the back-stage compressing part. The relationship between a wrap height $L_2$ (FIGS. 1 and 3) of the front-stage compressing part from the mirror plane $2c_1$ to the top of the wrap and a wrap height $L_1$ of the back-stage compressing part from the mirror plane $2c_2$ to the top of the wrap is set as $L_1>L_2$.

The joining face 2*m* has a self-lubricating dust seal 12 consisting of such as a fluorocarbon type resin in the channel provided in part 2 such that the dust seal 12 rubs on the mating face of revolving scroll 11.

The front-stage discharge port 2*e* (FIG. 4, FIG. 5) connected to the discharge pipe 6, which is shown in FIG. 1, and the back-stage suction port 2*f* (FIG. 4, FIG. 5) connected to the suction pipe 7 are provided on the mirror planes $2c_1$ and $2c_2$ respectively. A stationary scroll wrap 9*b* which forms the front-stage compressing part is embedded counterclockwise and spirally, and a stationary scroll wrap 9*c* which forms the back-stage compressing part spirals clockwise from a land part 9*a* where these ports are disposed. Channels are provided on the tops of the wraps, i.e. the upper tips of the wraps and self-lubricating tip seals 14 consisting of such as a fluorocarbon type resin are inlaid into said channels.

Cooling fins 2*b* are embedded, as shown in FIG. 1, in the back sides of the mirror planes $2c_1$ and $2c_2$ of the stationary scroll housing 2, and a housing cover 4 is fitted over the top of the cooling fins to form a cooling passage 2*n*. Thus, the scroll fluid machine is constructed so as to be able to cool the stationary scroll by air for cooling flowing through the direction vertical to the drawing plane of FIG. 1. A pipe 5 is fitted so as to be able to entrap fluid to the passage 2*a*.

As shown in FIG. 3, the revolving scroll 11 has a mirror plane 10*c* which is disposed, as shown in FIG. 1, opposite to the dust seal 12 and touching to said dust seal 12 provided on the joining face of the stationary scroll. The mirror plane 10*c* has a revolving scroll wrap 10*a* embedded on the outer part thereof, which forms the front-stage compressing part and a revolving scroll wrap 10*b* embedded on the center part thereof, which forms the back-stage compressing part. Regarding wrap heights from the mirror plane 10*c* to the tops of wraps, the revolving scroll wrap 10*b* of the back-stage compressing part is set as higher than the revolving scroll wrap 10*a* of the front-stage compressing part in accordance with the aforementioned heights of the stationary scroll relation $L_1>L_2$.

Channels are provided on the tops of the wraps and self-lubricating tip seals 13 consisting of such as a fluorocarbon type resin are inlaid into said channels.

The revolving scroll wraps 10*a* and 10*b* are disposed opposite to the stationary scroll wraps 9*b*, 9*c* with respect to their wall faces.

Cooling fins 11*a* are embedded, as shown in FIG. 1, in the back-side of the mirror plane 10*c*, and an auxiliary cover 15 is fitted over the top of the cooling fins to form a cooling passage 11*n*. Thus, the scroll fluid machine is constructed so as to be able to cool the revolving scroll by cooling air flowing through the direction vertical to the drawing plane of FIG. 1.

Said auxiliary cover 15 has a bearing 18 on the center side thereof, which supports in rotation an off-centered end part 16*a* of a rotational driving shaft 16, and also has bearings 19 on the peripheral side positions trisected in the peripheral direction thereof, which supports crank parts for preventing the rotation of the revolving scroll.

The crank part has a shaft 22 on one side of a plate 21 which fits said bearing 19 and a shaft 23 on the other side of the plate having an offset center with regard to that of the shaft 22. Said shaft 23 fits a bearing 20 provided on a driving shaft housing 3 so as to set the position. Thus, the revolving scroll 11 is constructed so as to be capable of revolving movement by eccentric rotation of the off-centered end part 16*a* of the rotational driving shaft 16.

The driving shaft housing 3 has an open space through the direction vertical to the drawing plane of FIG. 1 so as to cool the fins 11*a* of the revolving scroll by the cooling air flowing therein. A bearing 17 of the center part supports in rotation the rotational driving shaft 16 connected to a shaft of a driving motor, which is not shown in the figure.

In thus constructed scroll body 1, as shown in FIG. 1, the revolving scroll revolves as the off-centered end part 16*a* rotates around an axis 16*b* by rotation of the rotational driving shaft 16, and, as shown in FIG. 4, the compressed fluid drawn from the suction port (the passage) 2*a* of the stationary scroll housing 2 is obtained by the revolving scroll wrap 10*a*, that is, constrained into the sealed spaces $S_1$ and $T_1$ defined by this wrap and the stationary scroll wrap 9*b*.

Though said sealed spaces are offset by 180 degrees, approximately equal volumes are constrained at the same time.

Said sealed space is compressed, as shown in FIG. 4 and FIG. 5, in order of $S_1 \rightarrow S_2 \rightarrow S_3 \rightarrow S_4 \rightarrow S_5$ and then the front-stage discharge port 2*e*→the intermediate route→the back-stage suction port 2*f*→$S_6 \rightarrow S_7 \rightarrow S_8 \rightarrow S_9$. The sealed space obtained as $T_1$, as shown in FIG. 1, is compressed in order of $T_1 \rightarrow T_2 \rightarrow T_3 \rightarrow T_4$ and then the front-stage discharge port 2*e*→the intermediate route→the back-stage suction port 2*f*→$T_5 \rightarrow T_6 \rightarrow T_7 \rightarrow T_8 \rightarrow T_9$ to be delivered to the center part. $S_9$ merges with $T_9$ to flow out of the discharge port 2*d* and be discharged from a discharge pipe 8.

As the sealed space $S_9$ has the same space as $T_9$, as shown in FIG. 4, the fluids of the same pressure are discharged. The performance of the present embodiment of thus constructed scroll fluid machine is explained using FIG. 6 as follows.

A characteristic line of the sealed space pressure is depicted in FIG. 6 where a vertical axis P represents a pressure of the sealed space formed by the scroll wraps (an inner pressure of the fluid pocket) and a horizontal axis represents a rotational angle of the driving shaft or the crank shaft of the revolving scroll.

$L_3$ shows a characteristic line of compression in the front-stage compressing part. $L_4$ shows a characteristic line of compression in the back-stage compressing part in the case where the wrap height is higher than that of the front-stage compressing part. $L_1$ and $L_2$ show characteristic lines of compression in the backstage compressing part and the front-stage compressing part in the case where both of the wraps have the same height.

When the scroll fluid machine body starts running, the front-stage compressing part begins to draw in the fluid. The fluid in the medium route turns dilute as the fluid of the medium route is obtained in the volume T of the medium route between the front-stage discharge port and the back-stage suction port.

The fluid in the sealed space of the front-stage compressing part is compressed and pressurized along the line $L_3$ to point "b".

The compressed fluid flows to the medium route at point "c" due to the dilute fluid of the medium route to lower the pressure at the same time. After that, the fluid pressure increases by the compressed fluid supplied from the front-stage compressing part to recover the point "c" where the pressure is $P_2$.

The fluid of the point "c" is cooled by the cooler 24 in the intermediate route and supplied to the back-stage compressing part. After the point "c", the fluid is compressed in the sealed space of the back-stage compressing part to increase in pressure along line $L_4$.

Compared with the obtained fluid compression characteristic curve $L_1$, $L_2$, of a conventional scroll fluid machine with the present embodiment, in a conventional scroll fluid machine, fluid is compressed from the point "a" of the fluid pocket inner pressure $P_0$ to the point "b" of pressure $P_1$ and the compressed fluid is cooled at the point "b". Then the action is performed as shown in the characteristic curve from the point "b" to the point "d" of the fluid pocket inner pressure $P_3$ (discharge pressure) along $L_2$. Paying attention to the characteristic curve $L_2$ of the back-stage compressing part, a varying ratio Z of inner pressure of the fluid pocket corresponding to a given rotational angle amount $\Delta\omega$ expressed as $$Z=\Delta P/\Delta\omega \quad (1)$$

let $\Delta\omega$ be a given rotational angle amount, $\Delta P$ be a varied amount of the inner pressure of the fluid pocket corresponding to $\Delta\omega$.

On the contrary, in the present embodiment, fluid is compressed from the point "a" of the fluid pocket inner pressure $P_0$ to the point "c" of pressure higher than the point "b" and the compressed fluid is cooled at said point "c". Then the action is performed as shown in the characteristic curve from the point "c" to the point "d" of the fluid pocket inner pressure $P_3$ (discharge pressure) along $L_4$. Paying attention to the characteristic curve $L_4$ of the back-stage compressing part, a varying ratio Z' of inner pressure of the fluid pocket corresponding to a given rotational angle amount $\Delta\omega$ expressed as $$Z'=\Delta P'/\Delta\omega \quad (2),$$

let $\Delta\omega$ be a small given rotational angle amount, $\Delta P'$ be a variable amount of the inner pressure of the fluid pocket corresponding to $\Delta\omega$.

Hence, the resultant relation of $\Delta P'<\Delta P$ leads to the fact that the variable amount of the inner pressure of the fluid pocket $\Delta P'$ of the back-stage compression part in the present embodiment is smaller than $\Delta P$. Hence, as a reduction ratio $\Delta Y$ of a volume of a compression chamber which is formed by a scroll wrap and a scroll mirror plane is smaller in a back compressing part than in a front compressing part in the present embodiment, the discharge fluid pressure of the front-stage compressing part is set higher in the present embodiment than in a conventional scroll fluid machine and a gradient of the line $L_4$ is gentler than that of the line $L_2$ of the conventional one. Consequently, a multi-stage compression scroll fluid machine having a small variation $\Delta P$ in inner pressure of the fluid pocket containing the compressed fluid of each sealed space S or T corresponding to the given rotational angle amount $\Delta\omega$ of the revolving scroll and a stable discharge pressure can be offered.

Needless to say, though the present embodiment is explained as the case of longer distance between a wrap and a mirror plane in the back-stage compression part than in the front-stage compression part, a scroll fluid machine of the present invention can be constructed so that a distance between the mirror planes of the wraps in the front-stage compressing part together with the back-stage compressing part turns stepwise or gradually longer along the direction from the suction port to the discharge port of the fluid.

As described above, the present invention can offer a multi-stage compressing scroll fluid machine having a stable discharge pressure and a small scattering of varying amount of fluid pocket inner pressure $\Delta P$ in each sealed space S or T corresponding to the given rotational angle amount $\Delta\omega$ due to a gentle gradient of the characteristic curve of a pressure of a sealed space P because a varying extent of a pressure of the sealed space which forms a volume of a compression chamber defined by a scroll wrap and an oppositely facing scroll mirror plane is smaller in back-stage compressing part corresponding to the given rotational angle amount $\Delta\omega$.

What is claimed is:

1. In a scroll fluid machine having a multi-stage compressing part which further compresses fluid, which has been compressed by a front stage compressing part and cooled, with a back stage compressing part, a scroll fluid machine having a multi-stage compressing part which is characterized in that a depth of the wrap channel in a back-stage compressing part is larger than a depth of the wrap channel in a front-stage compressing part.

2. A scroll fluid machine having a multi-stage compressing part according to claim 1, wherein a death of scroll wraps which form a front-stage compressing part and a back-stage compressing part turns longer along the direction from the suction port to the discharge port for the fluid.

3. In a scroll fluid machine having a multi-stage compressing part which further compresses fluid, which has been compressed by a front stage compressing part and cooled, with a back stage compressing part, a scroll fluid machine having a multi-stage compressing part which is characterized in that a reduction ratio $\Delta Y$ of a volume of a compression chamber is smaller in a back compressing part than in a front compressing part, $\Delta Y$ being expressed by $\Delta Y=\{A(n-1)-An\}/A(n-1)$, altering the depth of the wrap channel or the wrap height from the top of the wrap to the mirror plane, where A is the volume of a compression chamber defined by a scroll wrap and a scroll mirror plane, $A(n-1)$ is the volume of a compression chamber at the rotational angle $\Delta\omega(n-1)$, An is the volume of a compression chamber at the rotational angle $\Delta\omega n$ and $\Delta\omega$ is the rotational angle of a driving shaft of a revolving scroll.

4. A scroll fluid machine having a multi-stage compressing part according to claim 3, wherein a depth of scroll wraps which form a front-stage compressing part and a back-stage compressing part turns longer along the direction from the suction port to the discharge port for the fluid.

* * * * *